US007703417B2

(12) United States Patent
Wu

(10) Patent No.: US 7,703,417 B2
(45) Date of Patent: Apr. 27, 2010

(54) BABY WALKER/WALKING SAFETY BELT APPARATUS

(76) Inventor: Tianyun Wu, 1390 Market St., #2614, San Francisco, CA (US) 94102

( * ) Notice: Subject to any disclaimer, the term of this patent is extended or adjusted under 35 U.S.C. 154(b) by 143 days.

(21) Appl. No.: 11/467,324

(22) Filed: Aug. 25, 2006

(65) Prior Publication Data

US 2008/0121191 A1 May 29, 2008

(51) Int. Cl.
*A62B 35/00* (2006.01)

(52) U.S. Cl. ..... 119/770

(58) Field of Classification Search ..... 119/770, 119/857; 434/255, 254, 253; 482/69; 182/3, 182/4; 297/468, 469, 485, 484
See application file for complete search history.

(56) References Cited

U.S. PATENT DOCUMENTS

| | | | | | |
|---|---|---|---|---|---|
| 1,050,874 | A * | 1/1913 | Twombly | 244/122 B |
| 1,193,374 | A * | 8/1916 | Gilliam | 482/69 |
| 1,326,716 | A * | 12/1919 | Dunning | 297/484 |
| 1,749,999 | A * | 3/1930 | Crocker | 482/69 |
| 2,956,646 | A * | 10/1960 | Isgren et al. | 188/32 |
| 3,237,939 | A * | 3/1966 | Olivet et al. | 482/69 |
| 3,778,052 | A * | 12/1973 | Andow et al. | 280/87.41 |
| 4,666,017 | A * | 5/1987 | Zimmerman | 119/770 |
| 4,922,860 | A * | 5/1990 | Hutchings | 482/69 |
| 4,981,110 | A * | 1/1991 | Llewellyn | 119/770 |
| 5,074,795 | A * | 12/1991 | Clark | 434/253 |
| 5,120,287 | A * | 6/1992 | Brown et al. | 482/69 |
| 5,388,551 | A * | 2/1995 | Martusciello | 119/770 |
| 5,766,114 | A * | 6/1998 | Campbell | 482/55 |
| 6,196,949 | B1 * | 3/2001 | Rodarte | 482/69 |
| 6,338,699 | B1 * | 1/2002 | Veitch | 482/69 |
| 6,836,902 | B2 * | 1/2005 | Marquez et al. | 2/69 |
| 2004/0192517 | A1 * | 9/2004 | Shiu | 482/69 |

OTHER PUBLICATIONS

Smart Baby Solutions, Life with Baby Trooper, Jul. 18, 2008, http://www.babytrooper.zoomshare.com, as seen by www.archive.org on Mar. 19, 2006 via http://web.archive.org/web/20060319232954/http://www.babytrooper.zoomshare.com/.*

* cited by examiner

*Primary Examiner*—Timothy D Collins
*Assistant Examiner*—Valentina Xavier

(57) ABSTRACT

A portable device to help adults hold and support their infants is a semi-circular belt-shaped fabric product that is preferably well-padded with soft durable materials. It comprises a center portion connecting with a pair of arm-extended elements, a pair of shoulder straps, a body strap, a pair of hand-holders and a pair of locking strap systems. It is primarily used for training and assisting infants to walk during the early development stages and beyond. It also functions to minimize back strain on the child caregiver by eliminating back bending when holding a child who is a significantly different height. The design provides this device with the advantages of long-term usage and multiple functions, such as securing an infant onto a chair.

15 Claims, 11 Drawing Sheets

57 cm-67 cm
22 cm
20 cm
20 cm
3cm
8.5 cm
2.5cm
13 cm
8
13
7
2
14A
6

8
13
6
14A
7

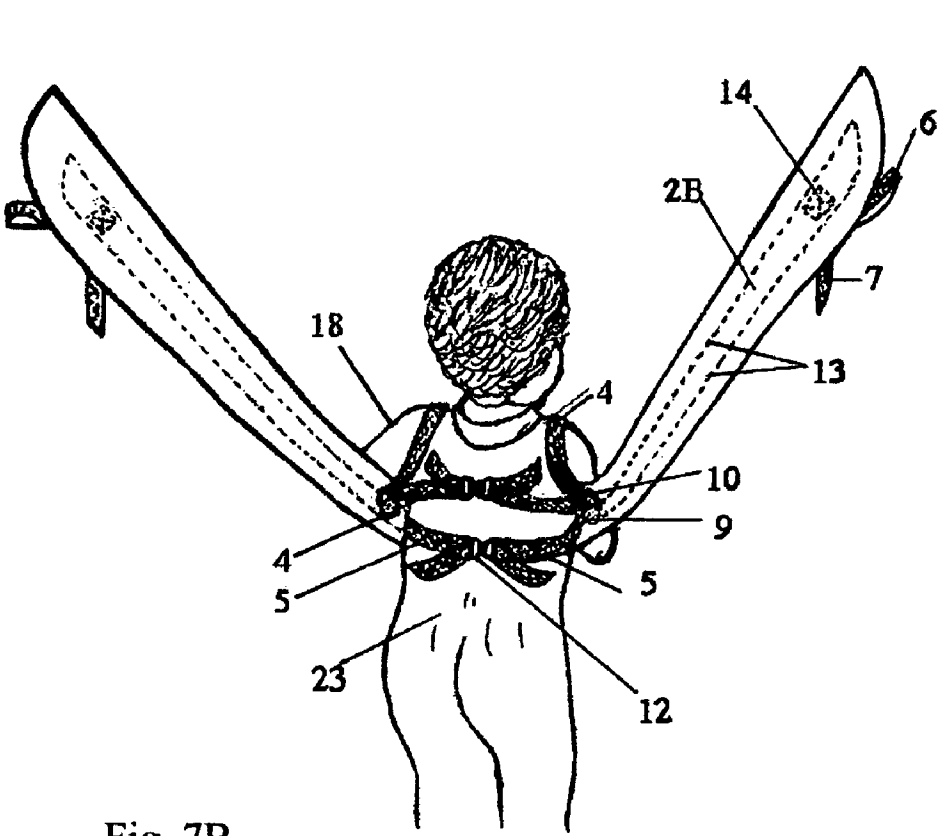
Fig. 7B
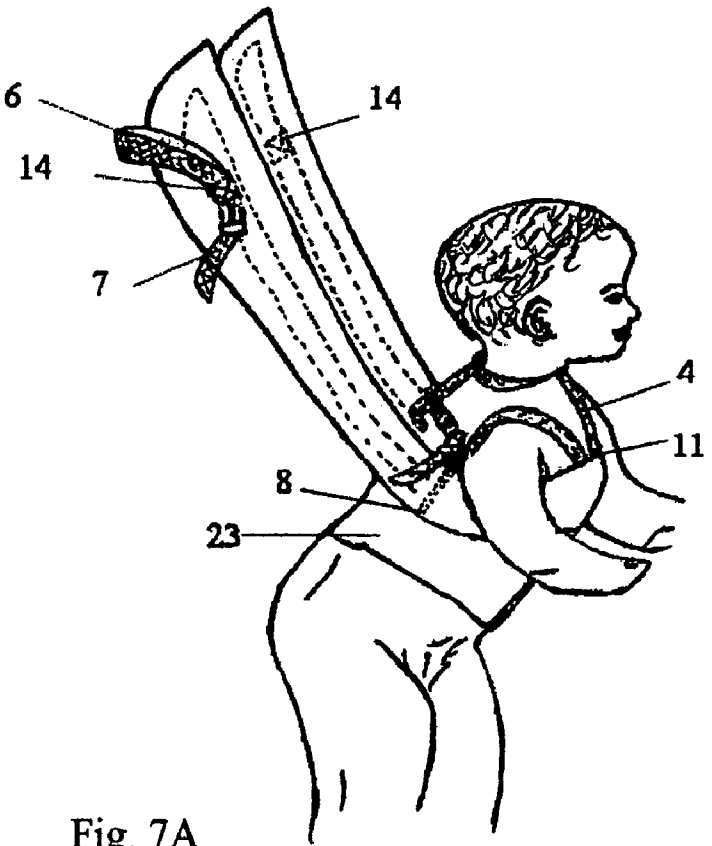
Fig. 7A
Fig. 7

9B.

9A.

BABY WALKER/WALKING SAFETY BELT APPARATUS

FIELD OF INVENTION

The present invention relates primarily to a child walking safety product.

BACKGROUND OF THE INVENTION

Today, older first-time parents are very common. Many women have their first child after 40 years of age. About 25% of all women in California have their first birth at an age over 35. This trend is seen all over the world. Many men at the age of 50-65 are fathering new babies. Many elderly people, such as grandparents, are childcare givers to their grandchildren. As soon as a small baby becomes mobile, such as crawling, standing, cruising and walking, the parents or attendants can expect a lot of work. Very often a small baby will trip and fall while learning to stand or walk. At those times, an older parent will have a very difficult time bending over, as many have by then experienced back injuries, back pain, or knee pain before having a child. Back pain and tiredness are common complaints by parents during the period when their children learn to walk.

Normal infants learn to walk as early as 6-7 months and as late as 14-16 months. During this period of time, a caregiver spends between 30 min per day to 3-4 hours per day assisting the baby with walking. Due to the significant height difference between a small child and his or her attendant, it is natural for the attendant to bend forward the upper-body to reach a small child with both arms and hands. Thus, this small child's arms or under arms are held by the attendant's hands. In other words, to be able to reach a small child, the attendant bends her/his back to hold the small child's arms when the child stands or walks. This is an extremely difficult position for many people, especially for an older person, a tall person or a person who has back problems. More importantly, when the child's arms are held by the attendant, the infant's arms and hands cannot move freely and naturally, so that the child is not able to touch, grasp, or play with objects as he or she desires. Also, the attendant's both hands are not free in this back bending position. Accidentally, many small children's arms or shoulders have been injured or twisted from sudden lifting or pulling because their attendants could not coordinate with the baby's movement.

Obviously, keeping a baby's hands free during walking exercise is very important in many ways: 1) it allows the baby to have good coordination between the body and hands, so that the baby can be in a natural physical position as much as possible during practicing walk; 2) most important, it helps to stimulate small babies brain development because it provides a great opportunity for a baby to receive information through hands. As we know, the learning process at this age relies mostly on hand touching. During the first three years of an infant's development, the brain develops most significantly in mass and in establishing synapses. It would be a great opportunity to receive a large amount of stimulations if a baby can go any place where a grown-up goes, such as walking into elevators, climbing up stairs, and walking on grass, pavement, shores of lakes or rivers, or anywhere. The more information a baby obtains, the more synapses can be developed, and the more intelligent a baby can become, and the earlier a baby can become independent. Learning how to step as well as obtaining information through this process will stimulate the child's brain development, which benefits both motor functions as well as intellectual development. Generally, due to safety concerns, most parents will not bring their babies to many places until their children reach a certain age. This present invention will provide a useful device to help save a lot of physical effort, avoid emotional stress and ease the burden of parenting. It helps stimulate small babies during the early development stage and explore the world safely.

The earliest infant-walking aid invention was made as early as 1913. U.S. However, effective baby walking aids for training a small baby to walk are still lacking in the market. For example, U.S. Pat. No. 1,193,374 granted in 1916, discloses a walking harness. This harness uses two parallel straps to surround the wearer's upper body. The hand-holding straps are narrowed straps that form a loop structure by connecting the ends. The harness is attached to the center back of the wearer. This design is very similar to most baby walking safety harnesses on the market today. The harness is normally operated by a single hand. The harness may be useful for keeping a toddler or older child nearby, but it is not a proper device to train a small baby to walk. When a baby is lifted at the center of the back, the baby can easily become out of balance and falls.

U.S. Pat. No. 1,749,999 helps an adult assist a small baby to learn how to walk. It was developed as a garment-like apparatus that is worn by a baby. Two straps extend from the back of the shoulder to be held by a caregiver's hands. There are many disadvantages in this prior art device: the hand straps are very narrow straps that provide no protection to the wearer. When the straps are pulled, the front anterior part of the apparatus could be pulled up toward the wearer's neck, and may become a choking hazard. No buckles were available at that time, and it seems difficult to put on or take off this apparatus. The wearer can become very hot when used during the summer.

U.S. Pat. No. 5,120,287 discloses a system in which two solid wood bars are provided for the caregiver and the baby to hold onto. The baby has to use his/her hands to hold onto the wooden bars, and therefore does not get his/her hands free. This prior art reference discloses a strap system used to hold on the baby's bottom, which does not seem to be convenient for a small baby when a baby starts to walk. It is always important for a baby that there is no obstacle below the waist and no other obstacle stretching between the legs. In addition, the solid rigid bar system is not as convenient as foldable clothes for storage and transportation.

The most recent U.S. Pat. No. 6,836,902, discloses a design similar to the design described in the U.S. Pat. No. 1,749,999, but adding a seat part for holding the wearer's bottom. The tensions at the baby's bottom and legs create an unnatural force by the infant when the harness is in use. Plus, this suit-like garment limits the time that it can be used. It may work for smaller or younger babies, and definitely not good for a larger or older babies. The hand leashes are thin, offer no protection and provide less control to the wearers. A baby wearing such a harness is like a baby in a suit or in a net. It may be too hot for a baby to use during summer and is not easy to put on or remove.

Baby walkers help a baby learn to walk. A baby walker has a seat and wheels that allow a baby to sit inside surrounded by a frame. The wheels allow a baby to walk around. For example, U.S. Pat. No. 3,778,052 shows a wheeled support structure. After baby walkers become popular several years ago, many babies fell from the stairs in these walkers and became seriously injured. Now, these wheeled walkers are considered dangerous for infants and have been taken off the market. In addition, even before they are able to walk independently, many small babies have strong desire to walk and play in the playground like the big kids do. They also desire to experience with their attendants in going into elevators, on stairs, through doors, and on pavement or grass. However, all of these wheeled devices for assisting a baby walk cannot fulfill these needs.

Currently, there are many types of baby safety walking harnesses in the market, which are intended for toddlers who are able to walk already. They are used as restraining devices for keeping the kids nearby and to avoid being lost in the crowd or on the street. Most of the walking harnesses are made from webbing straps and have a long leash attached on the center back; some are designed to attach to the both sides of under-arms. They are not designed or cannot be used to assist an infant to learn how to walk.

BRIEF SUMMARY OF THE INVENTION

This present invention provides a baby safety walking apparatus which is carried by a baby and held by an attendant. It is designed to secure and support activities of infants during their early stages of development, such as crawling, standing, or walking. It prevents trips and falls and gives confidence to the infants. It is mostly designed to help the attendant to release back strain and reduce the physical and emotional stresses when giving care to a small child. This baby walker/walking safety belt apparatus comprise a major body part and four additional strap systems:

1) A semicircular fan-shaped front center portion: it functions as human hands, supports and protects the wearer's upper torso. It is the wide and well-padded center portion of the apparatus that surrounds the wearer's chest area and terminates behind the armpits.
2) Two wing-shaped extended elements: they function as human arms to allow the attendant's arms extending long enough to be able to hold a small child without back bending. Child caregivers thus can stand and walk in a nearly normal position. The body part of the functional apparatus is the structure formed by attaching these two extended elements to the center portion. When lifted, the supporting force to the wearer is translated from the front chest to the left and right side of the armpits. The extended elements are designed as the shape of a dragonfly's wings, which are wide and well-padded. They can provide a strong lift and good support.
3) An adjustable shoulder strap system, wherein two straps are used to attach the apparatus to the wearer's body. Each shoulder strap passes through a shoulder strap holder which is attached to the inner side of an extended element, then connects to an adjustable buckle.
4) An adjustable body strap system, wherein a single body strap is held by a tunnel structure at inner side of the center portion. This body strap is able to close around the wearer's body, allows the apparatus to be securely attached on the body and connects the ends of the strap to an adjustable buckle.
5) A hand-holder strap system, wherein a loop-shaped structure is attached to the free end of an extended element. It allows a caregiver's hand to hold on the extended elements securely without losing the grip during use. An attendant would put each hand through a hand-holder and would then carry it on the wrist, so as to use the full hands to hold onto the ends of the extended elements.
6) A locking strap system, wherein a strap is connected to a hand-holder that is affixed on the free end of an extended element. This strap system allows this apparatus to form a closed circle by a fastening assembly, which can be held by one hand, can function as a seat safety belt to secure a child onto a chair, or can be carried on the attendant's shoulder when the apparatus is not in use.

With these designs, this baby walking safety apparatus has a fashionable appearance, and is simple and versatile. The functions of this present invention include the following:

1) This invention allows a human holding a child of significantly different height without bending the back, so that there is minimal or no back pressure produced.
2) This invention prevents falls when an infant learns to walk.
3) This invention is a sport trainer safety device for training a small child to ice-skate/ski, bike, and many other outdoor activities.
4) An added function is a safety restraining leash for toddlers.
5) An added function is a medical device or a physical therapy device for the child who has orthopedic problems.
6) An added function is a portable safety-belt that holds a baby onto a regular chair, a high-chair, car seat, stroller or shopping cart.

BRIEF DESCRIPTION OF THE INVENTION

Before an infant is able to stand or walk on its own, the posture of an infant walking looks like an ox pulling a wagon. The babies' weights are mostly on their bodies. They tend to use their upper bodies to pull the legs because their legs are not strong enough to support their bodies in an upright position. Therefore, the small baby can fall out of the balance very easily. As we can see, infants normally keep a semi-vertical position while walking by slightly bending their upper bodies forward. To help an infant maintain his or her balance, the effective supporting area is at the upper front torso. Because adults and small babies have significantly different heights, the adult human's arms are not long enough to reach a baby's arms without bending the back or bending the knees. Naturally, every childcare attendant has to bend his or her upper body to grasp the baby's arm or hands when a small child is learning to stand or walk. As soon as a human bending the body forwardly, a pressure or strain is generated on the human's back. It is extremely painful to the people who have back injuries. It is painful and unpleasant for everyone because it is not a natural relaxing human physical posture. Thus, to help adults assist small children to stand/walk safely and comfortably, a novel device is made here that can meet all of these challenges. This present invention is a significant improvement over the prior arts.

This apparatus is a symmetrical structure, preferably made from any kind of fabrics or other material with soft, durable and flexible natures, such as leather or plastic as the exterior portion. The padding-materials are preferably polyesters, but should not exclude any other soft, durable and flexible materials. The soft flexible feature of these materials offers this apparatus for holding, carrying and lifting the baby from any direction or angle. This apparatus has multiple usages, such as holding a baby onto a chair, or any other seat structures. The wideness and padded feature makes this apparatus strong, secure and easy to be used for pulling, lifting, and swinging a child without causing any discomforts.

The major body part of this apparatus comprises a center portion as the front bib. It translates from the front to just behind the armpits of the wearer, and functions as the supporting element for the upper torso. This center portion comprises a first surface and a second surface, with the first surface having an exterior surface and an interior surface.

Similarly, the second surface has an exterior surface and an interior surface. The first surface interior surface is opposite to the second surface interior surface, with padding materials inserted between the opposite surfaces. The best description of its shape is an inverted top portion of a hand-fan with narrowing ends. The important features of this center portion are: i) a wide and big middle portion; ii) gradually curving up ends from the center, the top edge being less curved and the bottom edge being more curved, and also iii) gradually narrowing down ends from the center, terminating with narrower ends. Since the attendant is significantly taller than the wearer, the pulling force comes from up from a slight vertical position, which is neither horizontal nor vertical. The shape of the center portion allows the connection with the extended elements in a perfect position to meet this consideration. The features above are essential to allow a) the center portion to fit naturally with the infant upper torso curve; and b) the pressure to be evenly diffused over a large area of the body without having any discomfort. The prior art baby walking safety harnesses use webbing straps. Even though some products used the padded feature, they are still too narrow to secure an infant when carrying or lifting an infant with 20-30 pounds of body weight. Plus, the body weight lands on the infant's front chest are not diffused in an efficient area and can cause extremely discomfort for a small child.

Two elements that extend the attendant's arms are designed as a pair of wings. They are referred to as extended elements. The extended elements attach to the center portion in symmetrical positions at both ends, giving this major body part of baby walking safety belt apparatus a semicircular shape. Similar to the center portion, each extended element comprises a first surface (outer side) and a second surface (inner side) where each surface has an exterior surface and an interior surface. A padding material is inserted between these interior portions. The shape of the extended elements looks like a dragon-fly's wing. The fixed end has the same width as the center portion's ends. The anterior edge is preferably straight, and the posterior is curved, gradually widening up from the fixed end to the free end, forming a wing shape like a dragon-fly's. When it is pulled, the extended element naturally slide up-right toward the attendant's front body from the wearer's back, like two human arms. They are wide and well-padded, providing good protection and a strong lift to the wearer, controlling the balance of the child when s/he is in any motion. In contrast, the prior art baby walking harnesses use webbing straps as a leash held by the attendant hands, providing no protection to the wearers. Thus, the body portion of the apparatus of the present invention assists infant to walk and extends the attendant's arms.

Two shoulder straps can be carried on the wearer's shoulder separately. They are used to secure the apparatus on the wearer's body. Each shoulder strap has two ends. The first end is preferably affixed on the center top of the center portion. The second end preferably passes through a D-ring which is affixed permanently on the extended element second surface (inner side) exterior surface adjacent to the center portion. Two shoulder straps are attached with a latching portion of a center buckle on the second ends. When it is in use, two straps are connected with each other from opposite direction and form a closed circle that translates from front to the back of the shoulder. Each latching part of the center buckle is designed to slide on the strap it is attached to, so that each shoulder strap is adjustable.

A body strap is a single long strap with a first end and a second end that encircles a wearer's body by a fastening assembly. It is used to secure the apparatus on the wearer's body. The first end is separated from the second end by passing through a tunnel-like structure, which is designed as a body strap holder patching on the inner side of the center portion. This tunnel-like structure has an exterior surface and interior surface. The interior surface is opposite to the exterior surface of the second surface of the center portion. It is a long narrowed rectangular shape with a width that a body strap can pass through without any difficulty. The length is always shorter than that of the center portion. This way, it can secure better to a smaller child. The ends of the body strap float out from each left or right opening and each connects to a center buckle latching portion. When the body strap is in use, the center buckle is latched on the wearer's back so that the center portion is securely attached on the wearer's body like a garment. The body strap can also secure a baby on a chair or a seat structure serves as a safety belt. By using a center buckle, the body strap is adjustable at both ends.

A hand grasp area is provided at the free end of the extended element that allows the attendant's hands to grasp onto the apparatus. A loop-shaped structure designed as a hand-holder provides a means of securing the attendant's hand without loosening grip on the apparatus. When the apparatus is in use, the attendant's hands passes through the loop and allow the loop to rest on the attendant's wrist, so that the attendant can grasp the extended elements fully.

An additional structure connecting to a hand-holder is a tail-like locking strap. A hand-holder and a locking strap are generated from a single strap by simply folding one end facing down toward the middle point and leaving the other end free like a tail. The middle point is attached to the outer side of each extended element, so either strap system can be positioned in the free end of each extended element. Thus, a hand-holder and a locking strap extend to opposite directions along the center line that parallels the extended element. Each tail-like locking strap is attached with a fastening portion of a center buckle. With a fastening assembly, the locking straps provide a means of connecting the free ends of the extended elements. This allows the extended elements to form a closed circle that is used to secure a baby on a chair, to be held by a hand or that rests on the attendant's shoulder.

When this apparatus is in use, both the shoulder straps and the body strap are latched together on the wearer's back. These two strap systems provide a double securing system that protects the wearer's back when the extended elements are pulled from the wearer's front. By using these two strap securing systems, this apparatus becomes a garment-like structure that securely surrounds the wearer's upper torso, and is able to withstand the force from any direction without becoming loose. While carrying, lifting, swing, or pulling the wearer, this apparatus provides a strong support and a secure area between the wearer and the attendant. The apparatus can function as a lifting carrier for easily moving a baby from one spot to the other spot.

When it is not in use, the apparatus can be kept on the wearer's back when babies are crawling, standing, walking or sitting. Its appearance looks like a decorative costume for a small child. The floating ends of the extended elements can be lifted up and folded over and crossed on the wearer's back; they are secured by the connecting shoulder straps. These two extended elements look like a pair of butterfly wings or a pair of angel wings freely floating on the wearer's back.

The advantages of this present invention over all other prior art are as following:

1. An apparatus of the present invention has a simple design, it is easy to make and easy to use.

2. It is a well-padded fabric product that provides soft and strong support to the wearers. The naturally adjustable fabrics meet these multiple functions and purposes perfectly.
3. The wide body part provides a strong support and protection, that allows the apparatus to be used by infants and eases the burden during the most difficult time of parenting:
   i) The center portion covers a large area of the wearer's body and provides good protection surrounding the upper torso.
   ii) The two extended elements are able to direct the wearer's movement from any direction, providing support to the wearer, and functioning as the extended human arms for the attendant.
4. This apparatus can remain on the wearer when the wearer is sitting, crawling or being carried by attendants.
5. Adjustable straps fit different sized babies, giving a long useful life and providing additional functions.
6. It is fashionable, looks like a costume with a pair of angel wings.
7. It is versatile and can be used for multiple purposes, such as:
   i) Physical therapy;
   ii) As a sport trainer safety belt;
   iii) As a portable chair safety belt;
   iv) As a leash of a walking harness;
   v) As a baby swing, providing good exercise for both babies and parents.

BRIEF DESCRIPTION OF THE DRAWINGS

FIG. 7A is a side elevation view of the baby walker/walking safety apparatus constructed in accordance with the present invention, showing how it is attached to a small child; FIG. 7B is a rear elevation view of the baby walker/walking safety belt apparatus constructed in accordance with the present invention, showing how the straps securely connected on a wearer's back.

FIG. 9 is a rear elevation view of the baby walker/walking safety belt apparatus constructed in accordance with the present invention, showing the apparatus resting on the wearer's back as: FIG. 9A shows the butterfly wings; FIG. 9B shows a pair of angel wings freely flowing on the wearer's back.

DETAILED DESCRIPTION OF THE INVENTION

Figures 1, 1A:
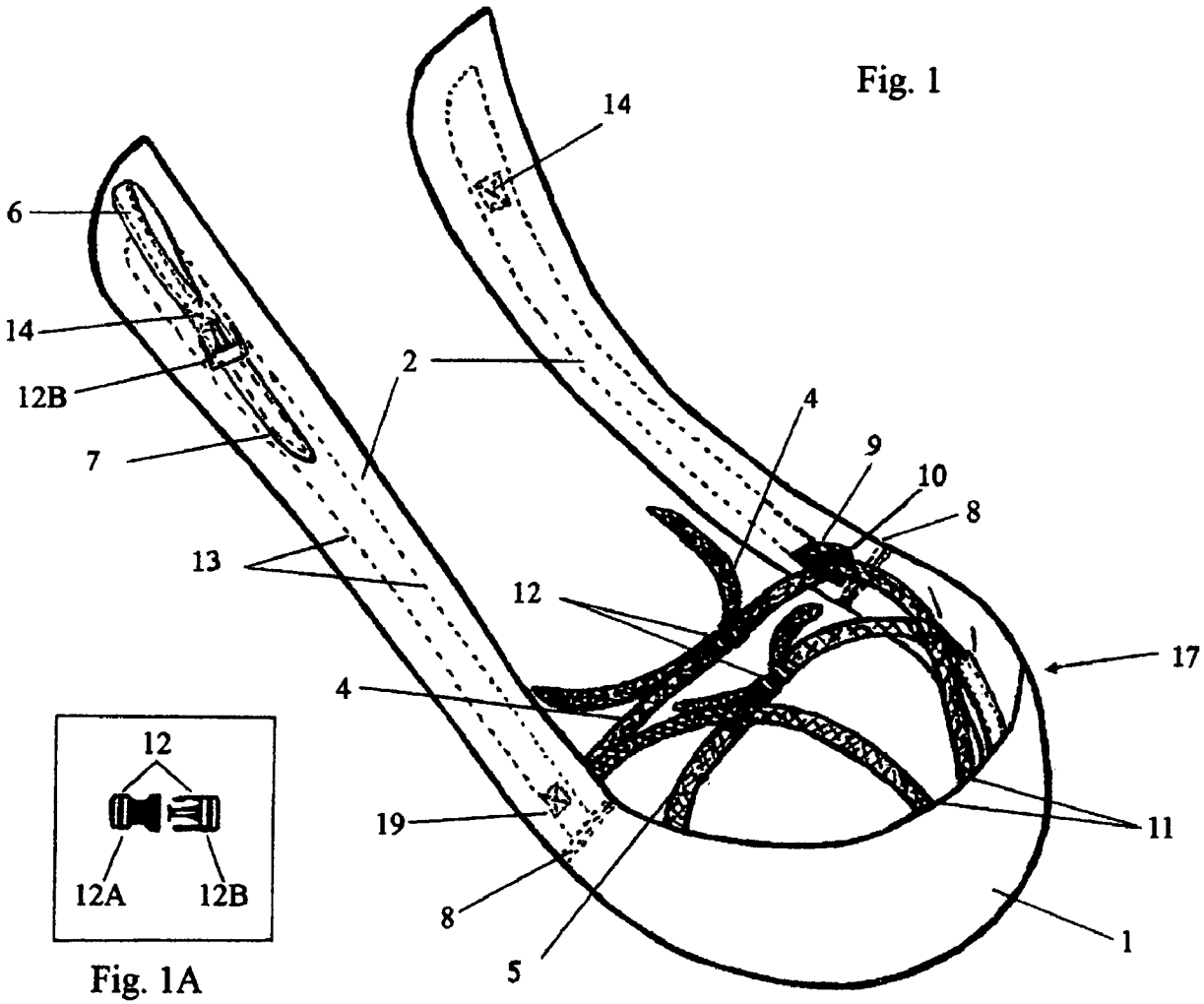
FIG. 1 is a side front elevation view of the baby walker/walking safety belt apparatus constructed in accordance with the present invention.
FIG. 1A is a bird's eye view of a known buckle structure employed by the present invention.
Figure 2:
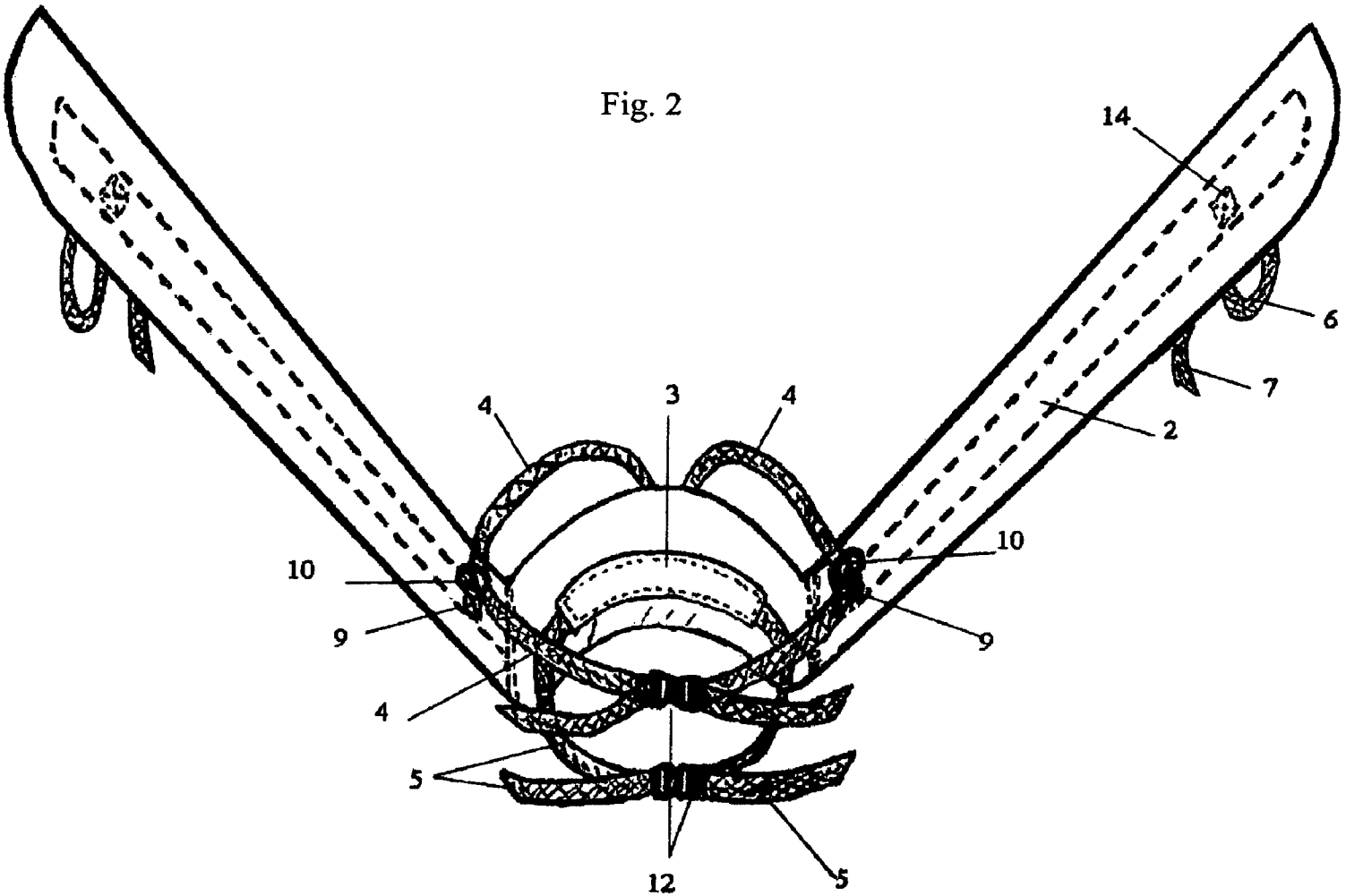
FIG. 2 is a rear elevation view of the baby walker/walking safety belt apparatus constructed in accordance with the present invention.
Figure 3:
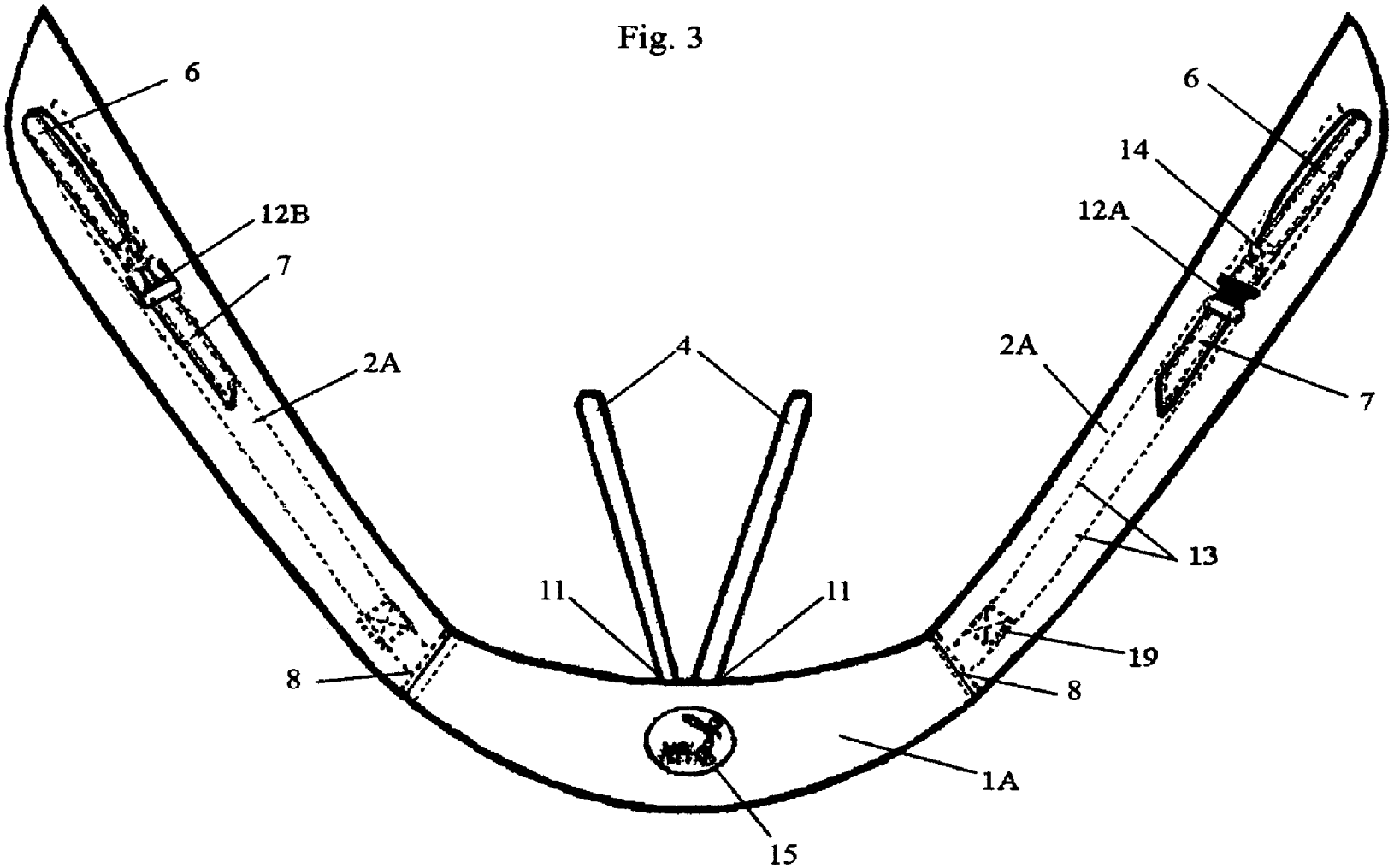
FIG. 3 is a bird's eye view of the outer side of the baby walker/walking safety apparatus with a symmetrical structure constructed in accordance with the present invention.
Figure 4:
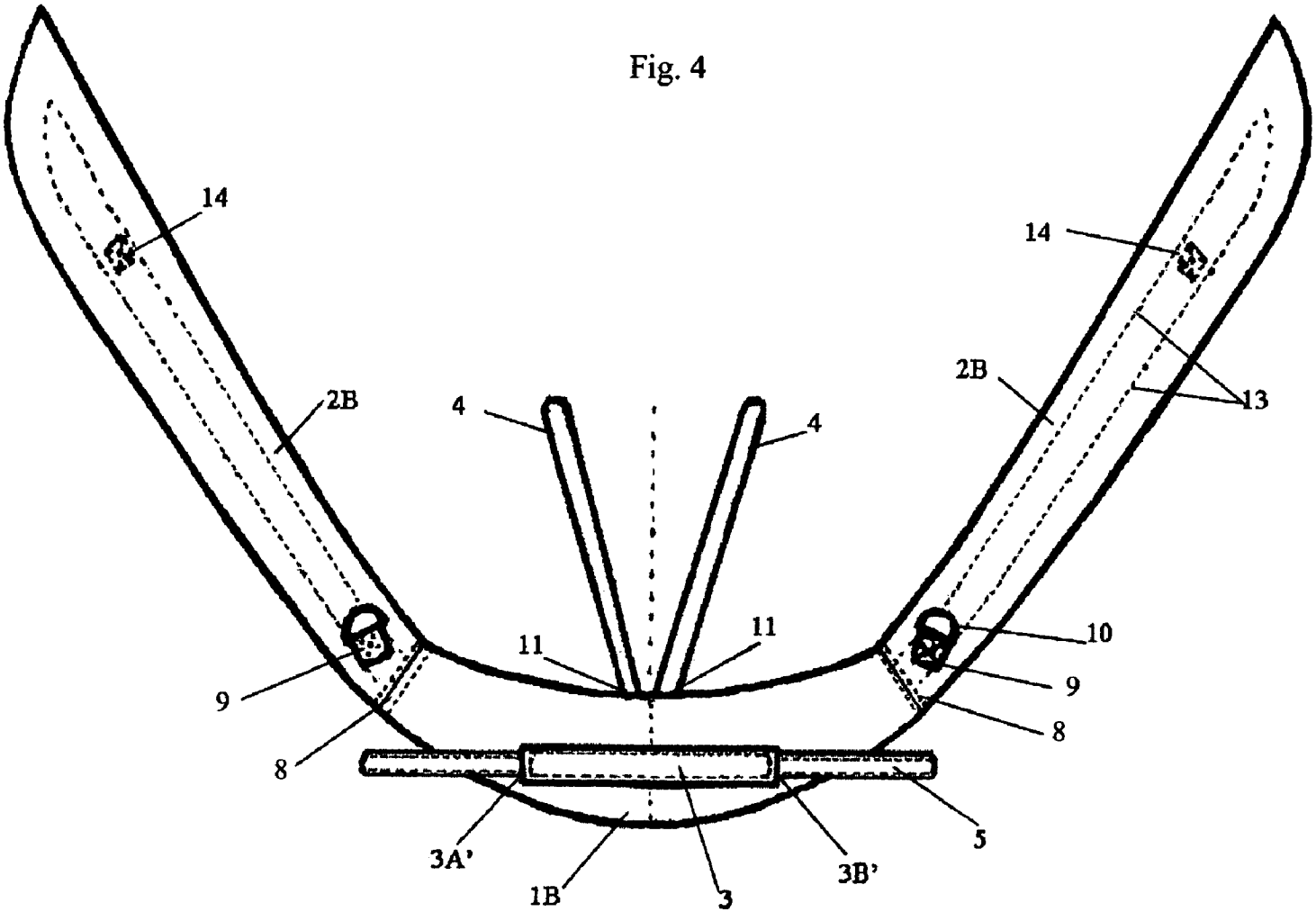
FIG. 4 is a bird's eye view of the inner side of the baby walker/walking safety belt apparatus with a symmetrical structure constructed in accordance with the present invention.

This invention provides a portable device for use by one holding an infant in any motion without back bending. It is used to train an infant walk. Referring now to the drawings, wherein similar parts of the invention are identified by like reference numerals. The baby walker/walking safety belt apparatus (17) as seen from the front side view in FIG. 1 having a main body part including a padded center portion (1) and two identical wing-shaped structures (2) referred to as the extended elements, which are joined at position (8) on both side. It comprises two securing strap systems that allow the apparatus to attach on the wearer's body, they are the shoulder strap system (4, 9, 10, 11, 12), and the body strap system (3, 5, 12). It also comprises a hand-holder strap system (6, 14) and a tail-like locking strap system (7, 14, 12). Overall, this walking safety apparatus is constructed in a symmetrical semi-circular shape, as seen in FIGS. 2, 3 and 4.

1. An apparatus of the present invention may be constructed mainly by six pieces of fabric, three pieces for the first surface of the apparatus, see FIG. 3; and three pieces for the second surface of the apparatus, see FIG. 4. The straps are preferably constructed by the same fabric as the exterior cover, and are padded with proper materials that can make the strap supportive and strong. The width of these straps is preferably 2.5 cm wide. The length of each strap varies from part to part as required.

Figure 5:
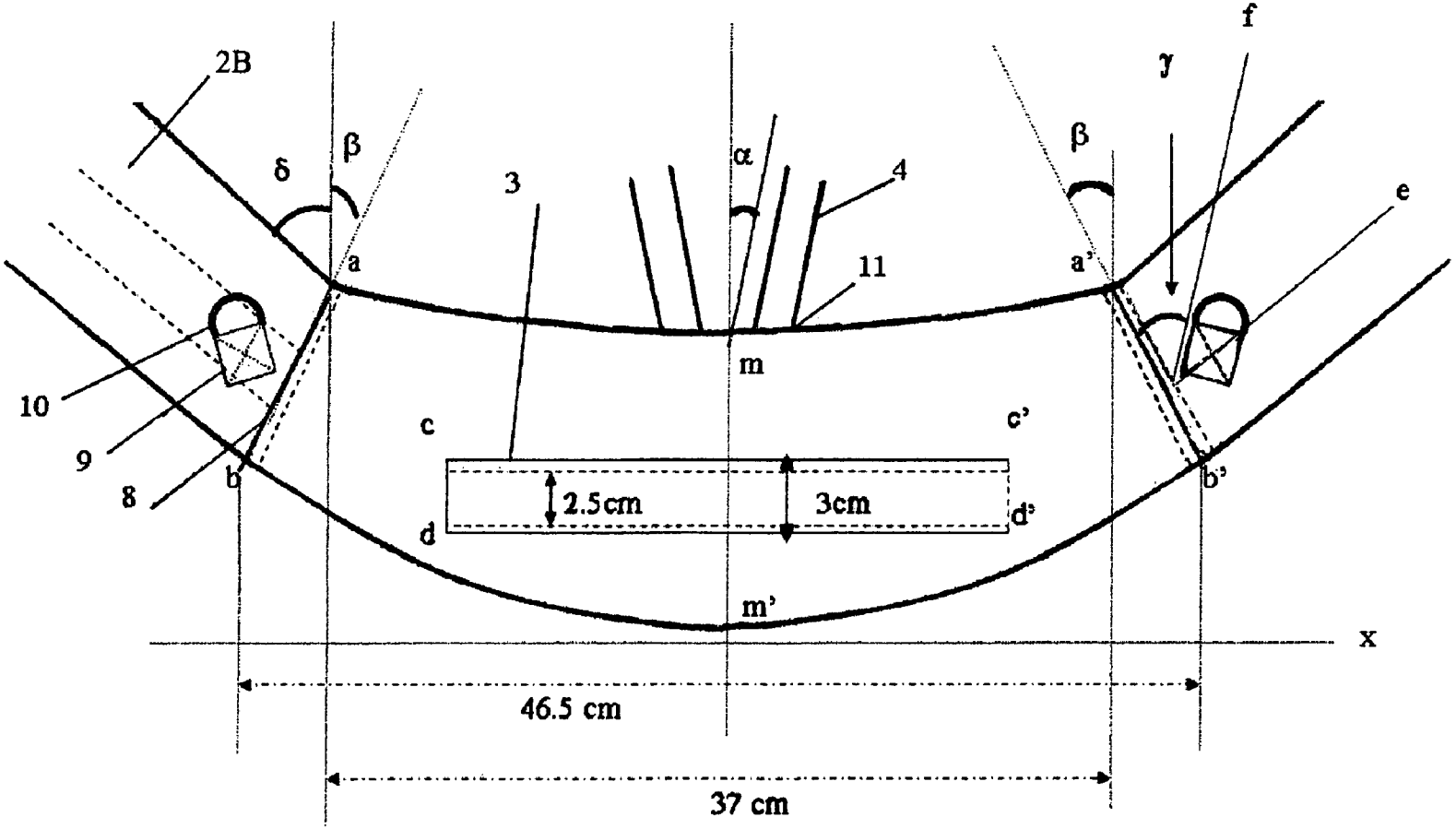
FIG. 5 is a detailed drawing of the inner side of the center portion of the present invention to showing its construction, in accordance with the present invention.

2. The center portion has two surfaces, the first surface (1A) and the second surface (1B), as shown in FIGS. 3 and 4. The exterior surface of the first surface (1A) contains a stitched logo (15) at the center portion, FIG. 3. FIG. 5 represents the basic parameters necessary for the construction of the apparatus, on the exterior side of second surface (1B). The hairy dash lines are employed here to illustrate the angles and measurements. The line x, is the horizontal line indicating the bottom edge position. The line y is the vertical line extended by the middle line of mm'. The length of m-m' of center portion (1) has a length of 12 cm from top edge (aa') to the bottom edge (bb'), and each end (a-b or a'-b') is 8.5 cm long. The distances between the two top edges represented by a-a' is 37 cm long; and similarly, the bottom b-b' is 46.5 cm long. The end of the center portion (a-b or a'-b') forms a 30-degree angle with the vertical line (a) or (a'). From the center, these two ends curve up smoothly toward the armpit areas, and then narrow down and terminate at the point (8) just behind the armpits. The bottom edge bb' forms a big arched shape with a big curve and the top edge aa' has a smaller curve. The distance from the edge b or b' to the line x is about 7 cm long. At a-b or a'-b', this center portion is connected with two extended elements (2) in a vertical position, respectively. Line e represents the center line of the extended element and is vertical to the line a'-b'. The other extended element is substantially the same.

3. A body strap holder (3) is on the exterior side of the second surface (1B) of the center portion. It is rectangular, being 28 cm long and 3 cm wide (see FIG. 5). By sewing the edges from c' to c, and d' to d, it forms a tunnel-like structure with two open ends (3A, 3A'), see FIG. 4. This structure can be constructed prior to connecting 1A and 1B together.

4. The two shoulder straps (4) are in symmetrical positions attached at (11) on the top of the center portion (1). Each shoulder strap is 40 cm long, having a fixed end and a free end. The second step of constructing the apparatus is to attached 1A and 1B together at its top edge aa' by sewing from the internal surface of each surface. During this process, each end of the body strap is inserted and affixed at position (11), see FIG. 5. The shoulder straps are about 4 cm apart. Each shoulder strap is 2 cm apart from the center line y and slides away from the center at a 20-degree angle, see FIG. 5.

Figures 6, 6A, 6B:
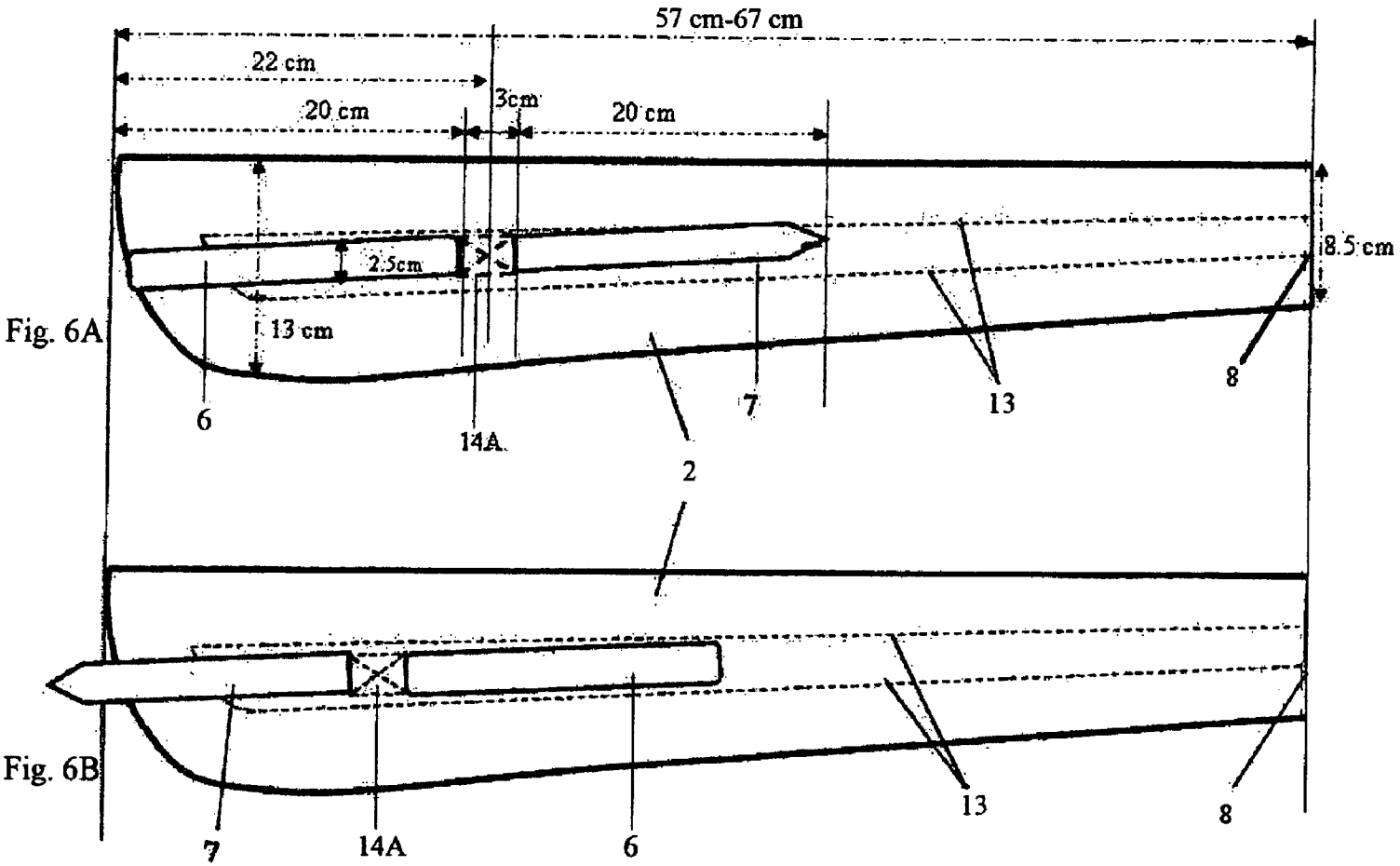
FIG. 6A and FIG. 6B are the bird's eye views of the outer side of the extended element of the baby walker/walking safety belt apparatus constructed in accordance with the present invention, showing two different manners of construction of a hand-holder and a locking strap.
Figure 8:
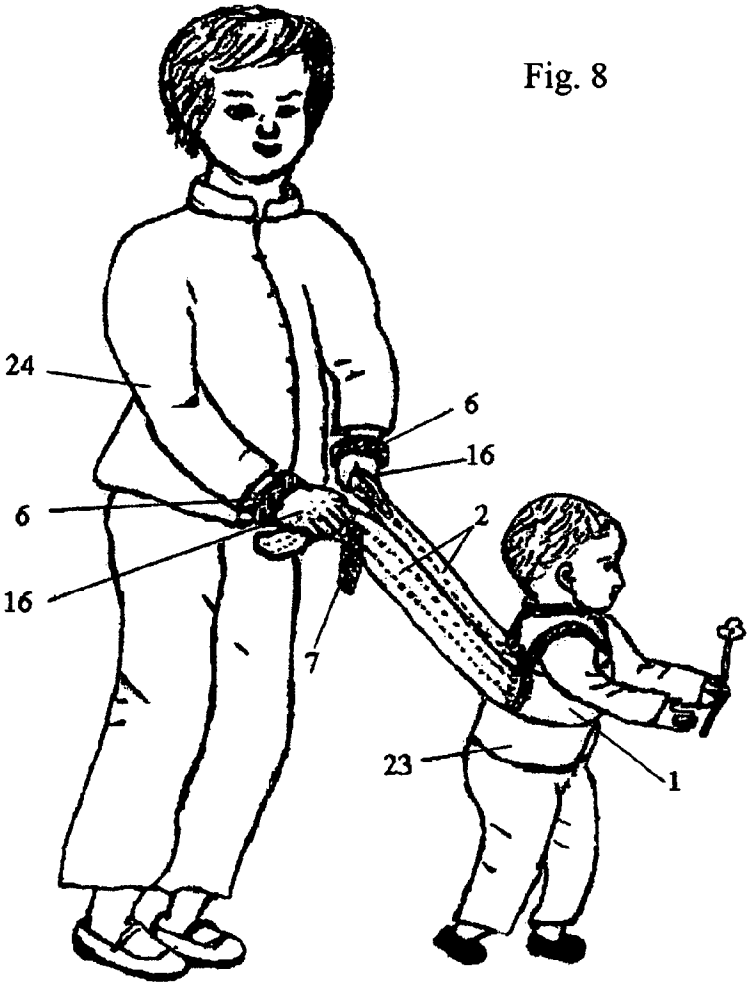
FIG. 8 is a side elevation view of the baby walker/walking safety belt apparatus constructed in accordance with the present invention; showing its use by an attendant helping a small baby learning how to walk.

5. The extended elements (2) each preferably have a first surface (2A) and a second surface (2B). But, in most cases, these two surfaces are cut into a single piece of fabric and fold on the center to form a wing-like shape as shown in FIG. 6. The opening edges are sewn together from internal side of the surfaces. After depositing the padding material, the padded extended element (2) is connected to the padded center portion (1) at (8) by sewing with at least two lines.

Figure 9:
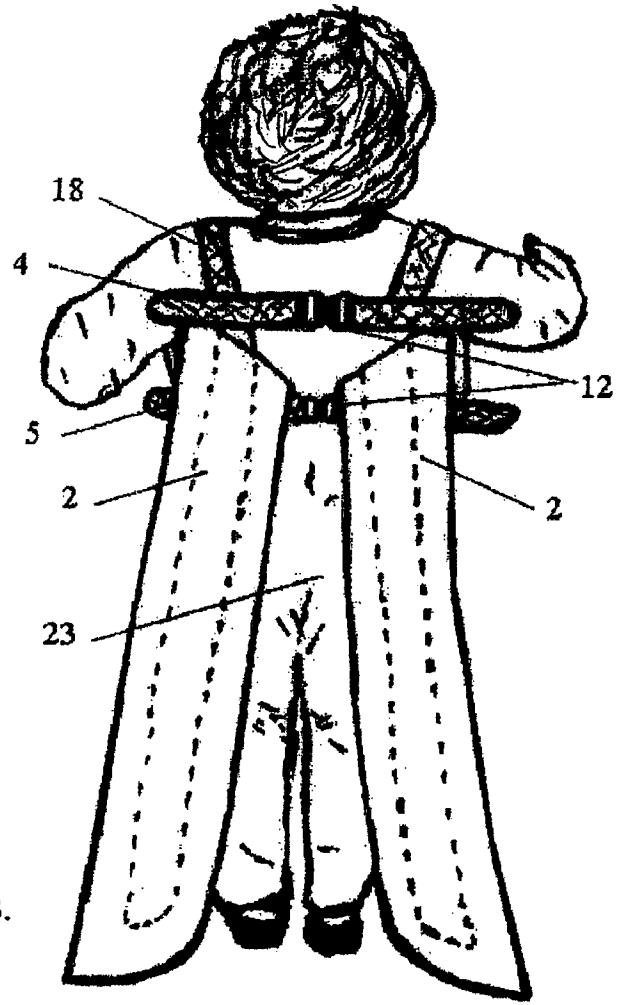
Figure 9:
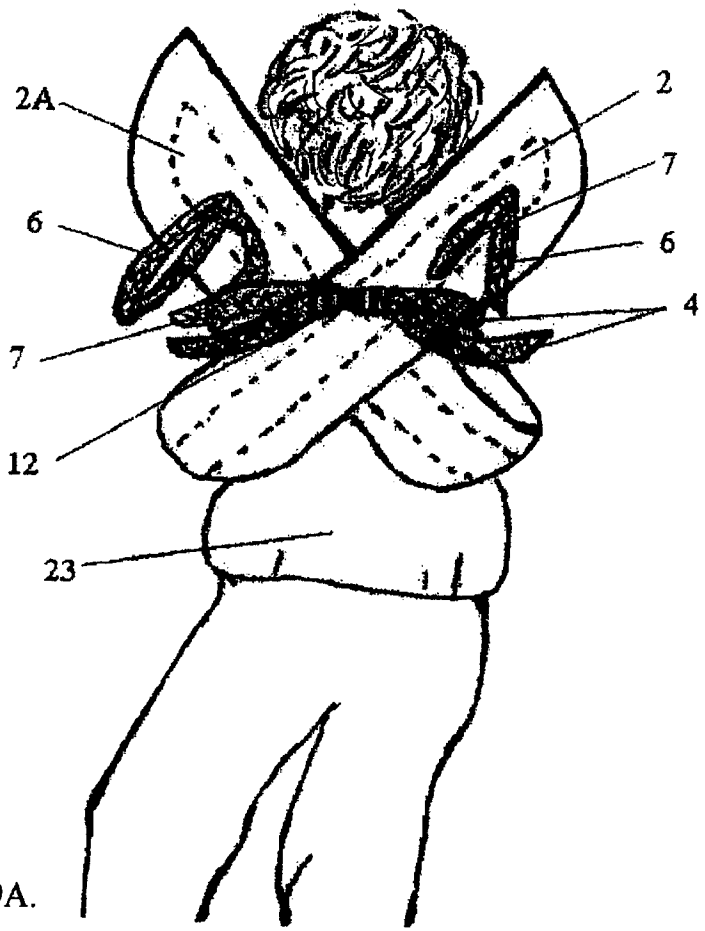

The shape of the extended element is designed as a dragonfly's wing, as shown in FIG. 6. The fixed end is 8.5 cm wide and is connected with the center portion (1) at point (8). This wing structure is gradually widening and curves up at the distal end. The widest part near the end is 13 cm wide. The length of the wing is about 57 cm. As described above, the angle between the extended element (line e) to the center portion's end (a-b) is about 90 degrees, and to the vertical line (line a' or line a) is near 60 degrees, see FIG. 5. Due to this angle of the connection, the extended elements extend upward naturally behind of the wearer's back, and to be held by the attendant's hands without back bending. The length of the extended element is not limited to 57 cm long. The purpose of this shape at the free end is for the fashion dictates. It looks like a pair of angel wings floating on the wearer's back, as shown in FIG. 9. Both the shape and the length of this extended element can be modified without losing its spirit and function. Two additional parallel stitched (13) lines on the extended element are necessary to make these wing-shaped structures much sturdy. With padding, these extended elements are durable and strong enough for stretching and heavy lifting.

6. A shoulder strap holder is constructed by a ring structure and a ring holder. Two D-ring (or triangle ring) structures (10) each are attached on the inner side (2A) of each extended element at (19) in symmetrical positions. Each D-ring (10) is affixed by a ring holder (9) made by a short strap, see FIG. 5. This ring holder (9) is about 3 cm long, 2.5 cm wide, attaching a D-ring prior to sew it on an extended element. The angle is about 45 degrees between the ring holder (9) (presented by line f) and the center portion (a'-b'). It is at the center position of the extended element, and is about 2 cm apart from the closest edge of the ring holder (9) to the center portion (a'-b'). This 45-degree angle allows the shoulder straps a) to connect with each other in a natural position on the wearer's back; b) to connect the center portion and the extended elements into a closed circle when both straps are latched together; c) to allow the extended elements resting on the wearer's back form a nice V-shape, see FIG. 9B. Each free end of the shoulder strap attaches to a latch portion of a center buckle (12) (see FIG. 1A) immediately after passing through this D-ring. When the apparatus is in use, the two ends are latched together on the wearer's upper back. With the additional latched body strap, this apparatus becomes a garment-like structure that completely secures the wearer's upper body and protects the wearer when in lifting, pulling, and swinging.

7. The body strap (5) is a free single strap that is 80 cm long. The first end passes through a tunnel-like structure (3), and come out of the other end of tunnel. Thus, these two ends are separated from each other at 3A and 3A', see FIG. 4. Each end is immediately attached to a latching portion of a center buckle (12A, 12B). Since this tunnel-like structure (3) provides a means of securing and strengthening the body strap which is not physically attached to the apparatus, thus, the body strap is removable and replaceable. The advantages of this design are: a) it makes the apparatus strong and secure; b) it allows this apparatus to fit all sizes of babies; and c) it gives multiple functions to the apparatus.

Figure 10:
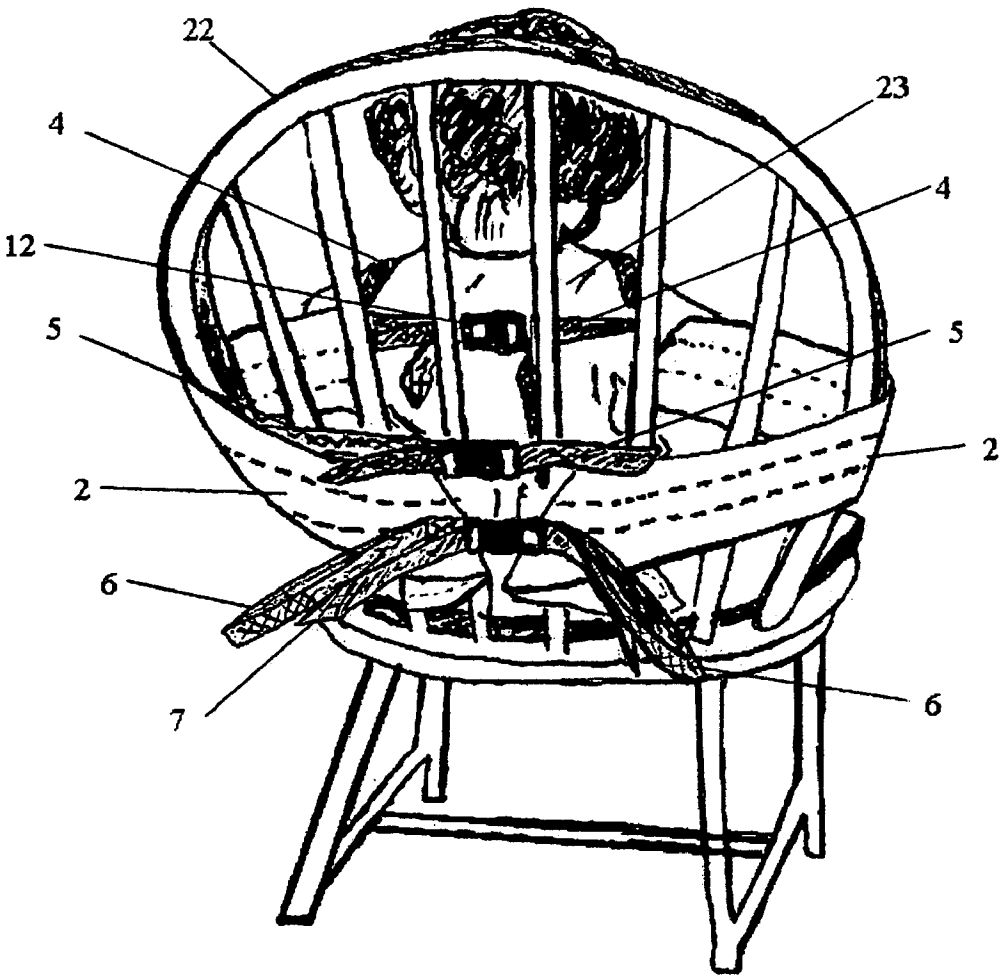
FIG. 10 is a rear view of the baby walker/walking safety belt apparatus constructed in accordance with the present invention, showing how to hold a baby onto a chair by the body strap and the extended elements when these straps are locked together by the center buckles.

8. Each extended element is constructed with a hand-holder (6) and a locking strap (7) near the free end, see FIG. 6. These two structures (6, 7) are constructed from a single long strap (66 cm), folding the first end of the strap toward the middle section to make a loop (6) of 23 cm long, then leaving the rest part free like a tail (7) about 20 cm long, and then, affixing the middle part with the first end facing down to the first surface (2A) of the extended element. A stitched area (14) is made about 3 cm×2.5 cm size centered on the extended element. The length of both structures is about 20 cm long. They extend in the opposite directions and parallel to the extended elements, see FIG. 6. Each locking strap is connected with a latch portion of a center buckle (12) which is facing toward the free end of the extended elements, see FIG. 3. The hand-holder (6) and the locking strap (7) can be made in two different manners, see FIG. 6A, 6B. The position of structures (6) and (7) showing in FIG. 6A allows the apparatus to attach on a chair with a narrower back. The position of structures (6) and (7) showing in FIG. 6B offer a better means of latching the two extended elements together. There is no difference on the function of holding a child to walk. When the locking straps help to form a closed circle, this apparatus can hold a child on a chair (23), see FIG. 10. The loop-shaped hand-holders (6) allow the attendant's (24) hands (16) to pass through, and then rest on the wrists, which prevent the hands (16) from losing the extended elements, see FIG. 7.

9. In addition, extra padding can be provided in the armpit area to provide extra comfort when a strong lift occurs.

10. The present apparatus is preferably made of fabric. Since the fabric is soft and flexible, it does not need to be taken off while baby is in crawling, sitting, and eating positions. To avoid the extended elements (2) from touching the floor, they can be simply lifted by crossing over each other and folded back on the wearer's back. When held by the latched shoulder straps (4, 12), these two extended elements form a pair of butterfly-like wings behind the wearer's shoulder, see FIG. 9A. Also, the two extended elements can float freely on the wearer's back like a pair of angel wings, FIG. 9B. Fabrics fit this purpose perfectly. During hot or warm weather, the wearers do not need to wear any clothes, so the cotton fabric for this apparatus is ideal. This present invention implements function of both usefulness and fashion. In contrast, the harnesses of the prior art made by webbing straps are too harsh for a baby to wear during the summer time. With careful design, this invention satisfies both needs that the prior art did not consider.

Figures 11, 11A, 11B, 11C:
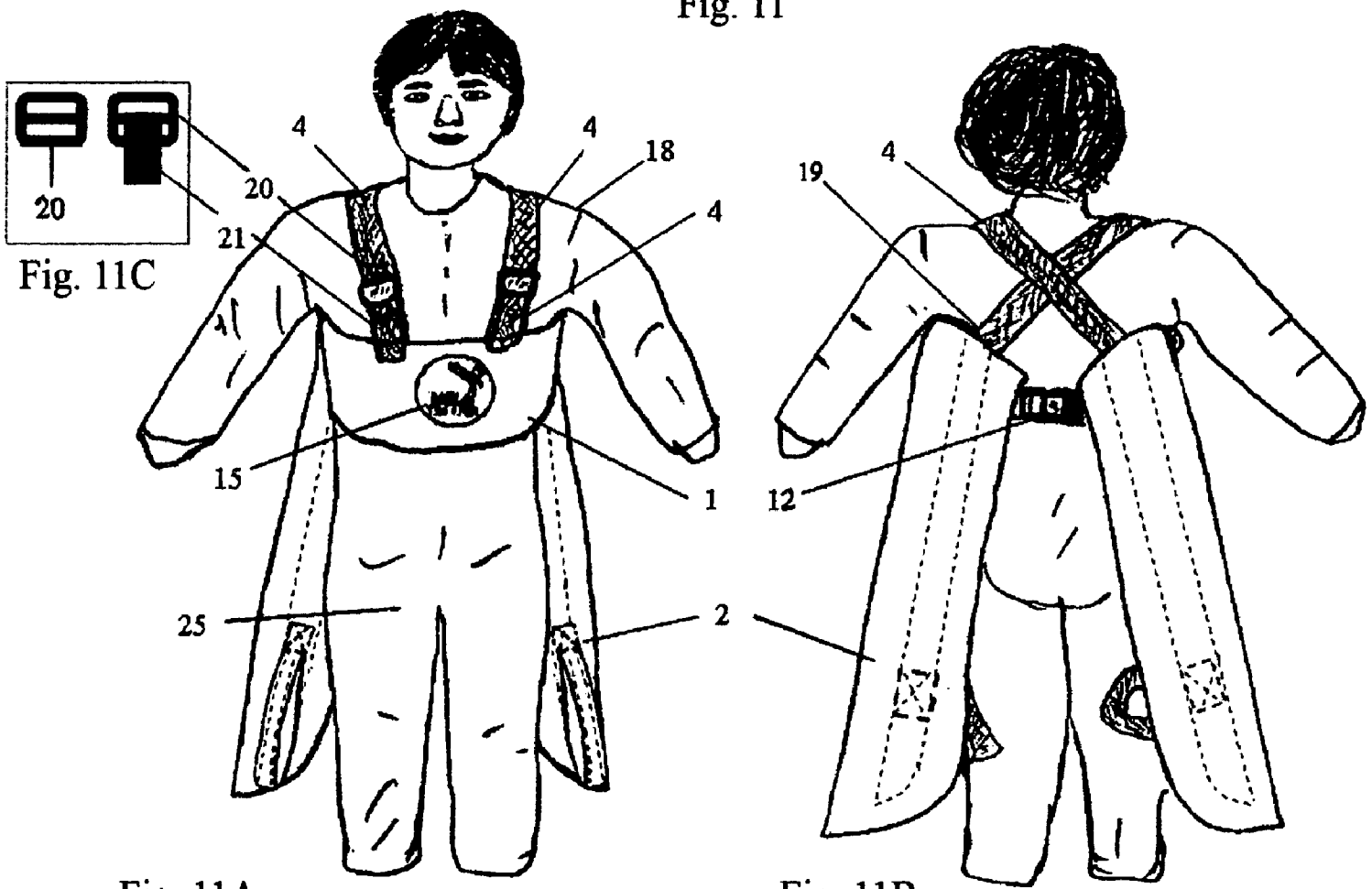
FIG. 11A and FIG. 11B depict a front view and a rear view of an alternative manner of installation and use of the shoulder straps.
FIG. 11C represents a strap slider employed by present invention.

11. FIGS. 11A and 11B represent alternative constructions of a shoulder strap system. A strap slider (21) (see FIG. 11C) fastens the free end of each shoulder strap. A slider-holder (20) (see FIG. 11C) is attached at the top edge of the center portion at the position (11). While sewing the two center portion surfaces 1A and 1B together from a to a', two slide-holders (20) are inserted between the surfaces in symmetrical positions, each apart from the center line y of 2-4 cm. The slider-holder (20) is made by a short strap into a loop structure of about 3-4 cm long, holding the center bar of a slider (21). The fixed end of each shoulder strap is attached at (19) wherein the same manner a ring holder (9) is attached. When these straps are in use, the free ends make a crisscross over on the wearer's back, see FIG. 11B, and then extend around the shoulders (18) and connect with the sliders (20) in the center portion, FIG. 11A. This manner of installation of the shoulder straps is as equally securing as the system described in section 4 and 6, above.

The invention claimed is:

1. A baby walker/walking safety belt apparatus attachable to an infant or a wearer and operated by an attendant who is significantly taller than the wearer, allowing an attendant to train, assist, or hold the wearer in a normal physical position, this apparatus comprises:

a) A semi-circular belt shaped main body part with i) a center portion connected to ii) two extended elements in symmetrical positions, the center portion supporting the wearer's upper front chest area, free ends of the extended elements provided for grasping by the attendant's hands; and b) securing strap systems including: two shoulder straps, each being secured at one of its ends to the top of the center portion, free ends of the shoulder straps each passing through a D-ring attached to the extended elements and connected to each other by a fastening assembly; a body strap system secured to the center portion by a tunnel-like structure and closing around the wearer's body by a fastening assembly; a pair of loop-shaped hand-holders attached on the free ends of the extended elements; and a pair of locking straps.

2. The apparatus of claim 1, wherein the center portion is padded to support a baby's upper front body.

3. The apparatus of claim 1, wherein the two extended elements are soft padded belts.

4. The apparatus of claim 1, wherein the extended elements are wing-shaped.

5. The apparatus of claim 1, wherein the center portion and the two extended elements are made as a single piece or as multiple pieces.

6. The apparatus of claim 1, wherein one of the securing strap systems allows the apparatus to be attached on the wearer's body.

7. The apparatus of claim 1 wherein the shoulder straps are affixed to either a top edge of the center portion or an inner side of one of the extended elements.

8. The apparatus of claim 7, wherein the shoulder straps each have a first end and a second end, wherein the first end is secured on the top edge of the center portion, and the second end passes through a D-ring that is attached on the inner side of one of the extended elements.

9. The apparatus of claim 7, wherein the second ends of the shoulder straps are connected to each other with a fastening assembly.

10. The apparatus of claim 7, wherein the shoulder straps extend across the back of the wearer in a crisscrossing fashion and connect to the center portion, the shoulder straps further attaching to a fastening assembly affixed on the top edge of the center portion.

11. The apparatus of claim 1, wherein the body strap system encircles the wearer's body by at least one body strap passing through a tunnel-like structure that is patched on an exterior surface of an inner side of the center portion.

12. The apparatus of claim 11, wherein the body strap system comprises a single strap having a first end and a second end.

13. The apparatus of claim 12, wherein the ends of the body strap connect to a fastening assembly.

14. The apparatus of claim 1, further comprising a pair of hand-holders wherein each loop-shaped hand-holder is attached to a free end of one of the extended elements to be used to secure a hand.

15. The apparatus of claim 1, further comprising a strap attached near the free end of each of the extended elements, each strap further including a fasten assembly that allows each strap to be adjustable, and further allows connecting each of the extended elements together to form a closed loop.

* * * * *